US007069745B1

(12) United States Patent
Finley

(10) Patent No.: US 7,069,745 B1
(45) Date of Patent: Jul. 4, 2006

(54) EAR ADORNMENT

(76) Inventor: Henry Earl Finley, 101 N. Pine Apt. 1 D, Chicago, IL (US) 60644

( * ) Notice: Subject to any disclaimer, the term of this patent is extended or adjusted under 35 U.S.C. 154(b) by 13 days.

(21) Appl. No.: 10/789,615

(22) Filed: Feb. 27, 2004

(51) Int. Cl.
*A44C 7/00* (2006.01)

(52) U.S. Cl. ..... 63/14.1; 63/14.3; 63/14.5; 63/14.7; 63/14.8

(58) Field of Classification Search ..... 63/14.1–14.9; 24/546, 205, 460, 462, 248 R
See application file for complete search history.

(56) References Cited

U.S. PATENT DOCUMENTS

| | | | | | |
|---|---|---|---|---|---|
| 2,490,908 | A | * | 12/1949 | Kohler | 63/14.7 |
| 2,498,748 | A | * | 2/1950 | Barron | 63/14.8 |
| 2,803,953 | A | * | 8/1957 | Zubalik | 63/14.1 |
| 3,034,320 | A | * | 5/1962 | Feibelman | 63/14.1 |
| 3,071,939 | A | * | 1/1963 | Feibelman | 63/14.1 |
| 3,739,599 | A | * | 6/1973 | Melone | 63/14.3 |
| 3,958,430 | A | * | 5/1976 | Barron | 63/14.2 |
| 4,187,696 | A | * | 2/1980 | van Bergen | 63/14.4 |
| 4,187,838 | A | * | 2/1980 | Dubrowski | 606/204.15 |
| 4,282,721 | A | | 8/1981 | Roach et al. | |
| 4,829,789 | A | * | 5/1989 | Tsamas | 63/14.3 |
| 4,840,045 | A | * | 6/1989 | Moody | 63/12 |
| 4,993,240 | A | | 2/1991 | Pounder | |
| 5,079,933 | A | * | 1/1992 | Alviti | 63/14.5 |
| 5,085,060 | A | * | 2/1992 | Matsushita | 63/14.1 |
| D337,740 | S | | 7/1993 | Rowray | |
| 5,379,611 | A | * | 1/1995 | Impagliazzo | 63/14.1 |
| 5,964,105 | A | * | 10/1999 | Nakamura | 63/14.1 |
| 6,026,658 | A | * | 2/2000 | Weller | 63/1.11 |
| 6,517,557 | B1 | * | 2/2003 | Sorribes | 606/151 |
| 6,568,212 | B1 | * | 5/2003 | Jacobs | 63/12 |
| 6,694,526 | B1 | * | 2/2004 | Tate | 2/209.12 |

* cited by examiner

*Primary Examiner*—Robert J. Sandy
*Assistant Examiner*—David Reese

(57) ABSTRACT

A ear adornment for allowing a user to adorn an ear of the user. The ear adornment includes a frame member being designed for selectively engaging the ear of the user. A sleeve member is selectively coupled to the frame member whereby the sleeve member is designed for being positioned adjacent the ear of the user when the frame member engages the ear of the user. The sleeve member is designed for providing the user with a unique appearance when the sleeve member is coupled to the frame member.

1 Claim, 3 Drawing Sheets

EAR ADORNMENT

BACKGROUND OF THE INVENTION

1. Field of the Invention

The present invention relates to facial adornments and more particularly pertains to a new ear adornment for allowing a user to adorn an ear of the user.

2. Description of the Prior Art

The use of facial adornments is known in the prior art. U.S. Pat. No. 4,993,240 describes a device for extending behind the ear of the user and is secured to a conventional earring to secure the adornment to the ear of the user. Another type of facial adornment is U.S. Pat. No. 4,282,721 having an elongated curved rod member that extends around a base of the ear to extend out from the bottom of the ear to the front of the earlobe of the ear to provide ornamentation proximate the earlobe of the ear. U.S. Pat. No. Des. 337,740 shows a ear ornament.

While these devices fulfill their respective, particular objectives and requirements, the need remains for a device that has certain improved features that allows adornment of the top of the ear.

SUMMARY OF THE INVENTION

The present invention meets the needs presented above by providing engaging portions of a frame member that extend from the front of the ear to the back of the ear to position the frame member over the top of the ear.

Still yet another object of the present invention is to provide a new ear adornment that allows adornment of the ear without of the need to pierce the earlobe or the cartilage of the ear.

Even still another object of the present invention is to provide a new ear adornment that allows the user to change the adornment member as desired by the user.

To this end, the present invention generally comprises a frame member being designed for selectively engaging the ear of the user. A sleeve member is selectively coupled to the frame member whereby the sleeve member is designed for being positioned adjacent the ear of the user when the frame member engages the ear of the user. The sleeve member is designed for providing the user with a unique appearance when the sleeve member is coupled to the frame member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
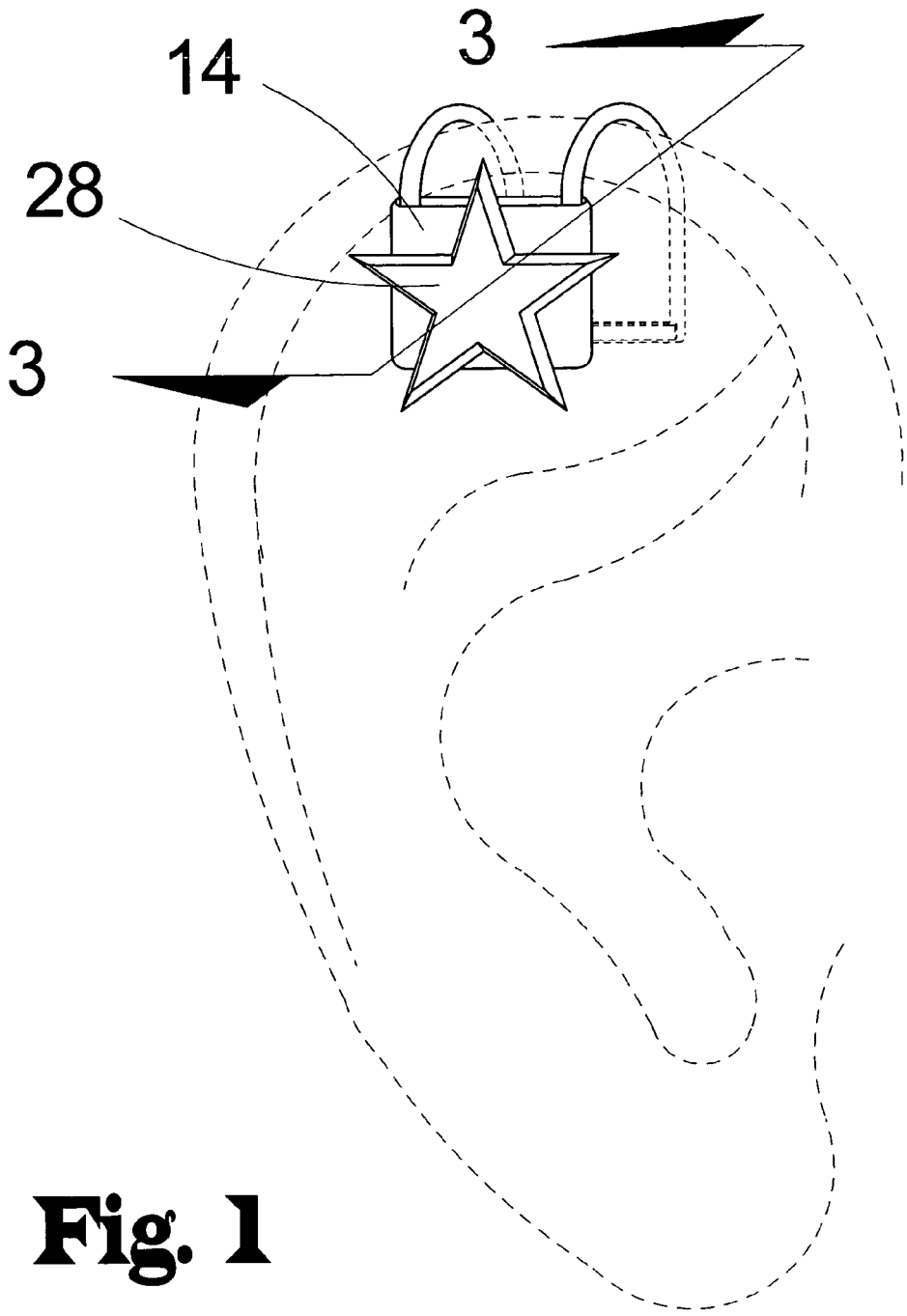
FIG. 1 is a perspective view of a new ear adornment according to the present invention shown in use.
Figure 2:
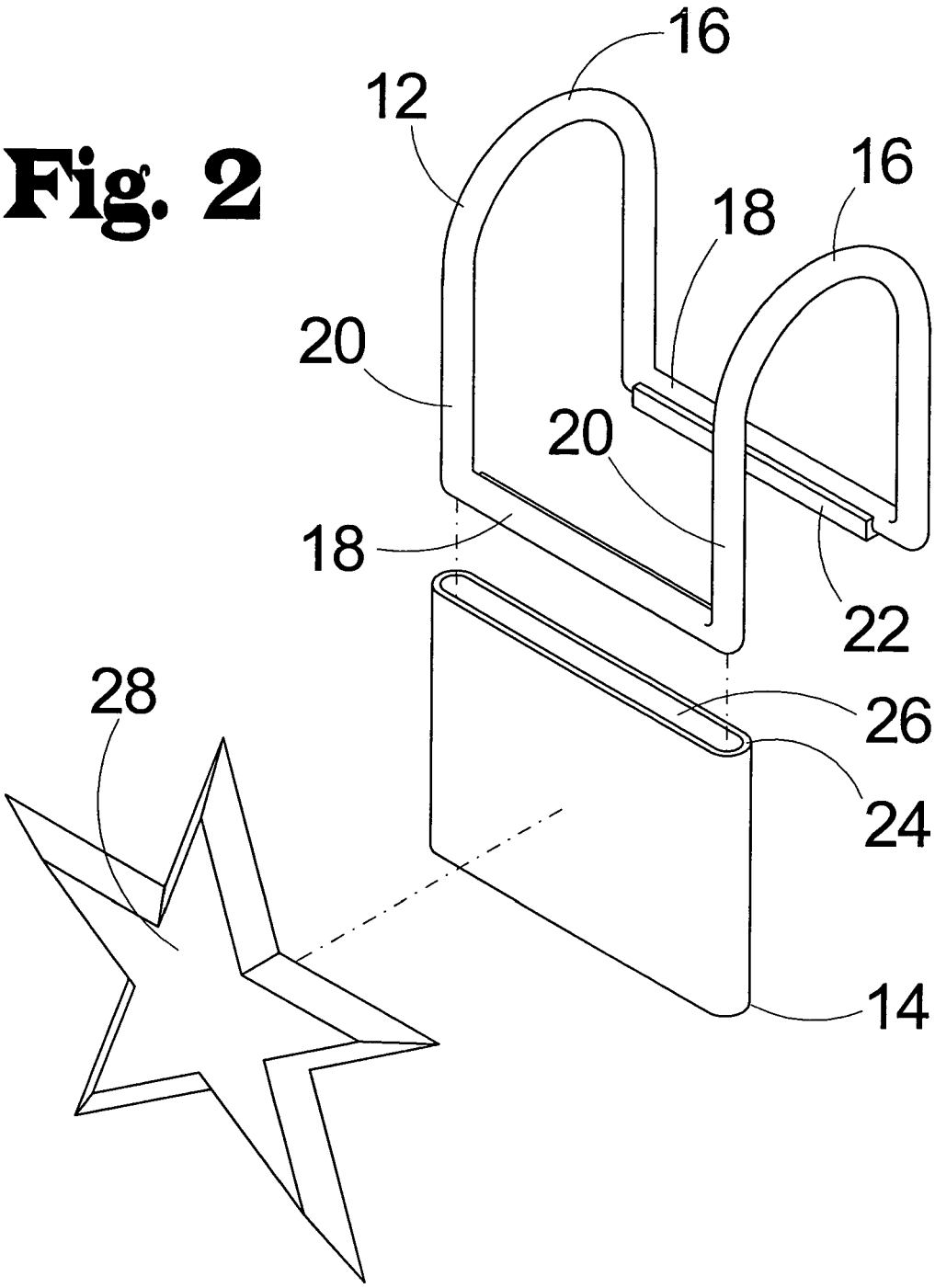
FIG. 2 is an exploded perspective view of the present invention.
Figure 3:
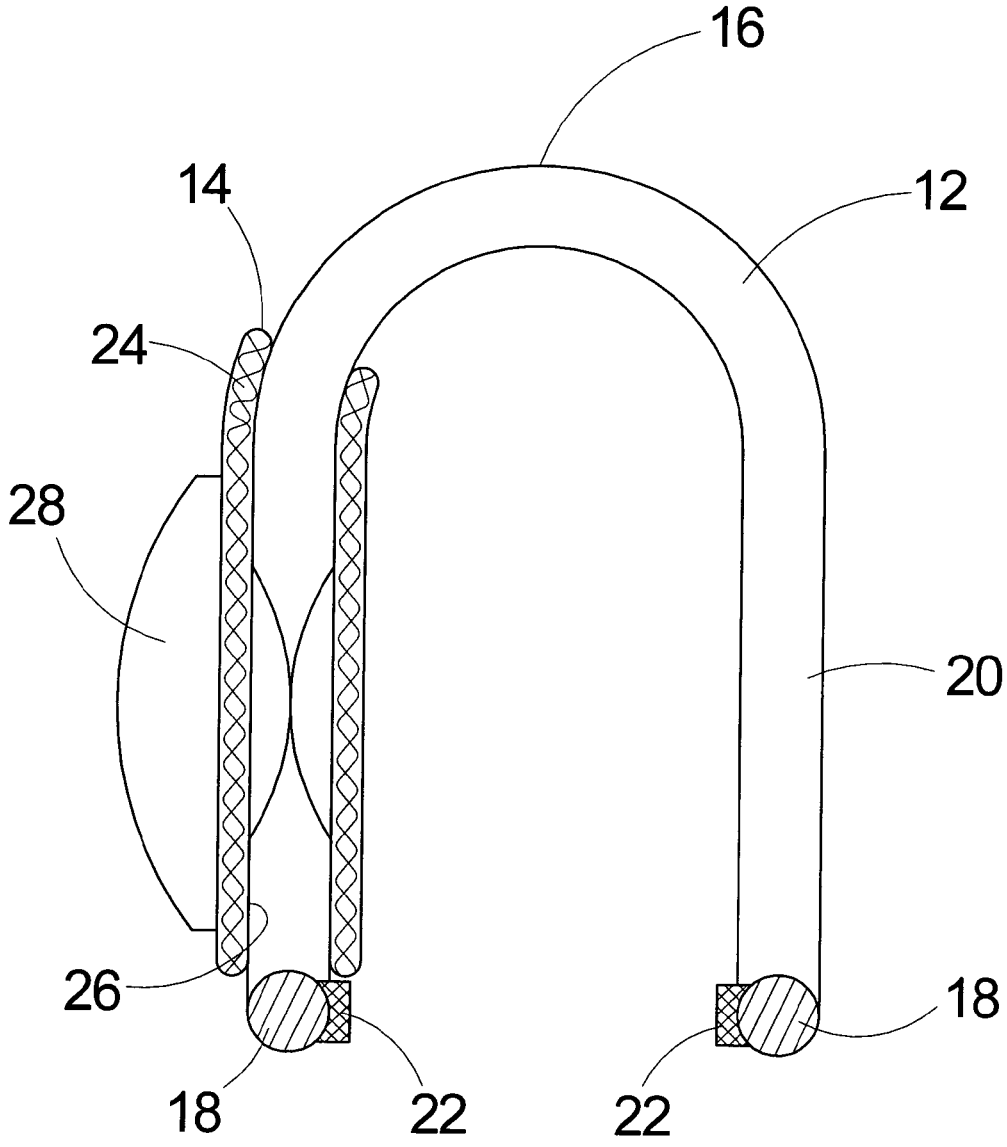
FIG. 3 is a cross-sectional view of the present invention taken along line 3—3 of FIG. 1.

With reference now to the drawings, and in particular to FIGS. 1 through 3 thereof, a new ear adornment embodying the principles and concepts of the present invention will be described.

As best illustrated in FIGS. 1 through 3, the ear adornment generally comprises a frame member 12 being designed for selectively engaging the ear of the user.

A sleeve member 14 is selectively coupled to the frame member 12 whereby the sleeve member 14 is designed for being positioned adjacent the ear of the user when the frame member 12 engages the ear of the user. The sleeve member 14 is designed for providing the user with a unique appearance when the sleeve member 14 is coupled to the frame member 12.

The frame member 12 comprises a pair of engaging portions 16. Each of the engaging portions 16 is designed for extending around a portion of the ear of the user whereby each of the engaging portions 16 extends from a front of the ear to a rear of the ear of the user. The sleeve member 14 is couplable to the engaging portions 16 of the frame member 12 whereby the sleeve member 14 extends between the engaging portions 16. Each of the engaging portions 16 comprises a resiliently flexible material. The resiliently flexible material is designed for permitting each of the engaging portions 16 to substantially conform to a general shape of the ear when each of the engaging portions 16 extends from the front to the back of the ear.

The frame member 12 comprises a pair of alignment portions 18. Each of the alignment portions 18 is coupled to one of a pair of free ends 20 of each of the engaging portions 16 whereby one of the alignment portions 18 is positioned adjacent the front of the ear of the user and the other of the alignment portions 18 is positioned adjacent the rear of the ear of the user. The alignment portions 18 maintain alignment of the engaging portions 16 when the engaging portions 16 are extending around the ear of the user.

The frame member 12 comprises a pair of magnetic members 22. One of the magnetic members 22 is coupled to one of the alignment members whereby the other one of the magnetic members 22 is coupled to the other one of the alignment members. One of the magnetic members 22 magnetically attracts the other one of the magnetic members 22 whereby the magnetic members 22 gently compress the ear between the magnetic members 22 to maintain positioning of the frame member 12 when the frame member 12 engages the ear of the user.

The sleeve member 14 comprises a perimeter wall 24. The perimeter wall 24 defines a receiving bore 26 extending through the sleeve member 14. The receiving bore 26 selectively receives at least a portion of the frame member 12 whereby the sleeve member 14 is selectively coupled to the frame member 12. The sleeve member 14 is designed for being displayed on the ear of the user when the frame member 12 engages the ear of the user. The sleeve member 14 comprises a flexible material. The flexible material permits the sleeve member 14 to conform to the portion of the frame member 12 received by the sleeve member 14 when the sleeve member 14 receives the frame member 12.

An adornment member 28 is selectively coupled to the sleeve member 14. The adornment member 28 is suspended from the frame member 12 when the sleeve member 14 is coupled to the frame member 12. The adornment member 28 may be coupled to the sleeve member 14 in a variety of methods, including but not limited to, a post and backing plate, a releasable adhesive or a pair of magnets that pinches the sleeve member 14 between the magnets and secures the adornment member 28 to the sleeve member 14. The adornment member 28 is designed for adorning the ear of the user when the frame member 12 engages the ear of the user.

In use, the user inserts a portion of the frame member 12 into the sleeve member 14 so that the sleeve member 14 is positioned over a portion of the sleeve member 14. A selected adornment member 28 is then coupled to the sleeve member 14 so that the adornment member 28 is suspended from the frame member 12 and the sleeve member 14. The engaging portions 16 of the frame member 12 are then positioned over a portion of the ear, such as the top of the ear. The engaging portions 16 are then gently flexed to allow the engaging portions 16 to be substantially contoured to the ear for comfort. One of the magnetic members 22 magnetically attracts the other one of said magnetic members 22 to allow the portion of the ear between the magnetic members 22 to be gently compressed by the magnetic member to maintain positioning of the frame member 12 when the frame member 12 engages the ear of the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ear adornment for adorning an ear of a user, the ear adornment comprising:

a frame member for selectively engaging an ear of a user; and a sleeve member being removably coupled to said frame member such that said sleeve member is positioned adjacent an ear of a user when the frame member engages an ear of a user to provide a user with a unique appearance when said sleeve member is coupled to said frame member;

wherein said frame member comprises a pair of substantially U-shaped engaging portions each having a throat for receiving an upper periphery of an ear of a user, the engaging portions each having ends that extend over an ear when said frame member is engaged with an ear, said frame member further comprising a pair of alignment portions extending between corresponding said ends of the engaging portions to join said pair of engaging portions together such that said pair of engaging members and said pair of alignment members form a continuous loop;

wherein said sleeve member forms a sleeve with an upper open end and a lower open end and an interior therebetween, the upper open end of said sleeve removably receiving one of said alignment members and a portion of each of said engaging members;

wherein each of said engaging portions comprises a resiliently flexible material for permitting each of said engaging portions to substantially conform to a general shape of an ear when each of said engaging portions extends from a front to a back of an ear;

wherein said frame member comprises a pair of magnetic members, one of said magnetic members being coupled to one of said alignment members such that a second of said magnetic members is coupled to another one of said alignment members, one of said magnetic members magnetically attracting the second of said magnetic members such that said magnetic members gently compress an ear between said magnetic members to maintain positioning of said frame member when said frame member engages an ear of a user;

wherein said sleeve member comprising a perimeter wall, said perimeter wall defining a receiving bore extending through said sleeve member, said perimeter wall including a pair of opposed wall portions, each of said opposed wall portions having a protrusion, each of said protrusions extending in opposition to said protrusion on the opposite one of said opposed wall portions;

wherein said sleeve member comprises a flexible material, said flexible material permitting said sleeve member to conform to the portion of said frame member received by said sleeve member when said sleeve member receives said frame member;

an adornment member being selectively coupled to said sleeve member, said adornment member being suspended from said frame member when said sleeve member is coupled to said frame member, said adornment member being adapted for adorning an ear of a user when said frame member engages an ear of a user; and wherein said throat formed by said engaging portions has a substantially uniform width and extends along a single axis.

* * * * *